US007500892B1

(12) United States Patent
Brice

(10) Patent No.: US 7,500,892 B1
(45) Date of Patent: Mar. 10, 2009

(54) MARINE PROPULSION SYSTEM

(76) Inventor: Keith Brice, 955 - 20th St., Lakeport, CA (US) 95453

( * ) Notice: Subject to any disclaimer, the term of this patent is extended or adjusted under 35 U.S.C. 154(b) by 0 days.

(21) Appl. No.: 11/648,247

(22) Filed: Dec. 29, 2006

(51) Int. Cl.
*B63H 23/34* (2006.01)

(52) U.S. Cl. ..... 440/83; 440/88 HE

(58) Field of Classification Search ..... 440/88 HE, 440/57, 83
See application file for complete search history.

(56) References Cited

U.S. PATENT DOCUMENTS

| | | | | |
|---|---|---|---|---|
| 366,662 | A * | 7/1887 | Harthan | 440/49 |
| 2,423,886 | A | 7/1947 | Hindmarch | |
| 3,154,047 | A | 10/1964 | Casale | |
| 3,240,179 | A * | 3/1966 | Van Ranst | 440/88 R |
| 3,505,894 | A | 4/1970 | Halibrand | |
| 3,570,319 | A | 3/1971 | Arnold | |
| 3,589,326 | A | 6/1971 | Celli | |
| 3,691,862 | A | 9/1972 | Halibrand | |
| 3,803,934 | A | 4/1974 | Yokel | |
| 4,188,833 | A | 2/1980 | Krauss et al. | |
| 4,276,034 | A | 6/1981 | Kashmerick | |
| 4,735,104 | A | 4/1988 | Giurati et al. | |
| 4,838,105 | A | 6/1989 | Yano et al. | |
| 5,503,578 | A * | 4/1996 | Cestaro | 440/83 |
| 5,509,863 | A | 4/1996 | Mansson et al. | |
| 5,580,289 | A | 12/1996 | Asbert | |
| 5,588,328 | A * | 12/1996 | Nihei et al. | 74/409 |
| 6,482,057 | B1 * | 11/2002 | Schoell | 440/53 |

* cited by examiner

*Primary Examiner*—Stephen Avila

(57) ABSTRACT

A propulsion system is disclosed for moving a hull of a watercraft through a body of water. The propulsion system includes a power transfer unit that comprises a housing with an interior, an input gear positioned in the interior for being rotated by the engine, and an output gear positioned in the interior and being rotatable by the input gear. The input gear is rotatable about a first axis and the output gear is rotatable about a second axis, and the second axis is oriented at a non-zero angle to the first axis. A primary output shaft is mounted on the output gear and extends from the interior of the housing to an exterior of the housing. An adjustable propeller assembly may be included that includes a propeller, with the propeller assembly being configured to enable adjustment of a direction of thrust provided by the propeller along an axis of rotation of the propeller.

20 Claims, 5 Drawing Sheets

MARINE PROPULSION SYSTEM

BACKGROUND OF THE INVENTION

1. Field of the Invention

The present invention relates to watercraft propulsion systems and more particularly pertains to a new marine propulsion system that produces a highly compact arrangement in a watercraft and which can permit adjustability of the direction of thrust produced by the propulsion system.

2. Description of the Prior Art

A number of marine propulsion designs have been proposed and implemented for moving watercraft through bodies of water, and some have even utilized power train configurations that have a generally V-shaped driveline configuration. However, it is believed that these known marine power train configurations typically occupy greater spaces in the watercraft than is necessary, and as a result space in the watercraft that could otherwise be occupied by the users of the watercraft is wasted by a power train that occupies a large portion of the interior of the watercraft. In some applications, the size of the watercraft could actually be made smaller if the space occupied by the power train were able to be smaller, especially if it is desired to make the watercraft more maneuverable or more fuel efficient.

It is therefore believed that there is a need for a marine propulsion system, and particularly a power train, that is highly compact and space-efficient for increasing the usability of space within a watercraft as well as other benefits that flow from a more space efficient design.

SUMMARY OF THE INVENTION

In view of the foregoing disadvantages inherent in the known types of marine propulsion systems now present in the prior art, the present invention provides a new marine propulsion system construction wherein the same can be utilized to produce a highly compact arrangement in a watercraft and which can permit adjustability of the direction of thrust produced by the propulsion system.

To attain this, the present invention generally comprises a propulsion system for moving a hull of a watercraft through a body of water. The propulsion system comprises a power transfer unit that comprises a housing defining an interior, an input gear positioned in the interior of the housing for being rotated by the engine, and an output gear positioned in the interior of the housing and being rotatable by the input gear. The input gear is rotatable about a first axis and the output gear is rotatable about a second axis, and the second axis is oriented at a non-zero angle to the first axis. A primary output shaft is mounted on the output gear for rotation with the output gear, and the primary output shaft extending from the interior of the housing to an exterior of the housing.

In some implementations of the invention, the input gear has a plurality of spiral bevel teeth and the output gear has a plurality of spiral bevel teeth intermeshed with the plurality of spiral bevel teeth on the input gear. In some implementations, a cooling apparatus is provided for receiving a flow of cooling fluid to cool lubricant in the interior of the housing, and comprises a cooling conduit extending through the interior of the housing.

In some implementations, an adjustable propeller assembly receives power from the power transfer unit and includes a propeller, with the propeller assembly being configured to enable adjustment of a direction of thrust provided by the propeller along an axis of rotation of the propeller.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The inventive system may, in addition to providing a more compact power train arrangement, also provide easier installation and replacement of driveline components, and reduce maintenance and serviceability issues.

The advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
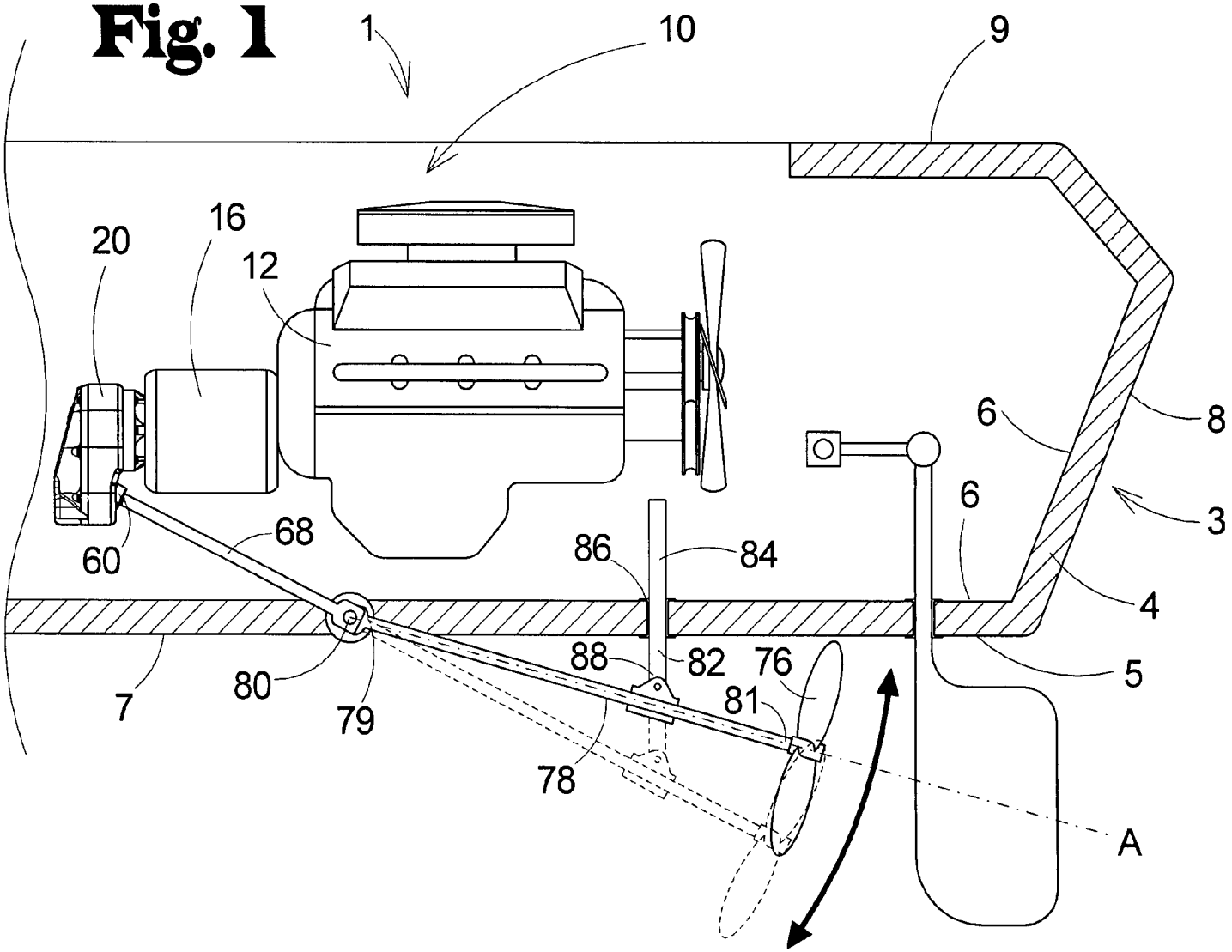
FIG. 1 is a schematic side sectional view of a watercraft employing the new marine propulsion system according to the present invention.
Figure 2:
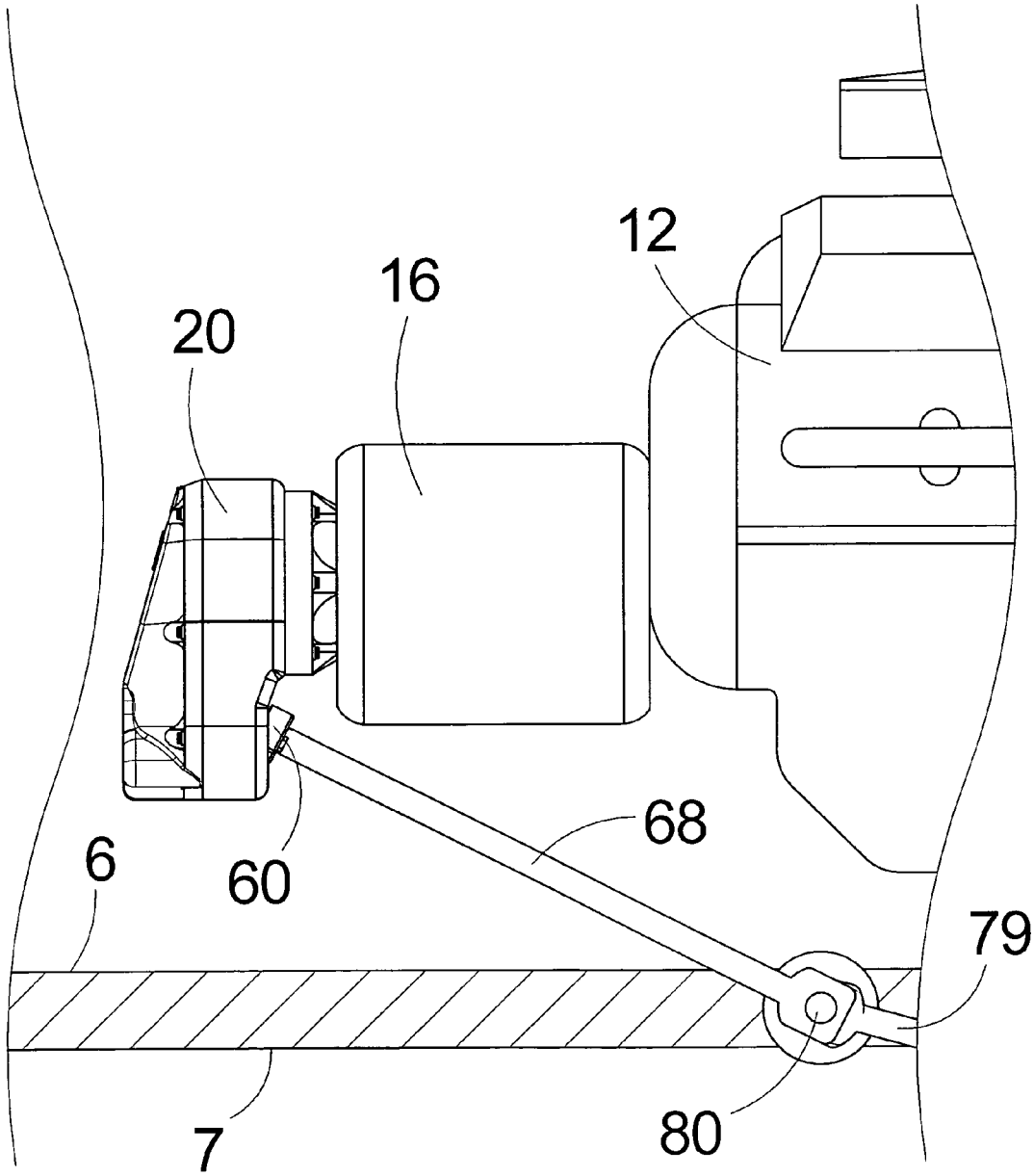
FIG. 2 is a schematic perspective view of the engine, transmission and power transfer unit of the present invention.
Figure 3:
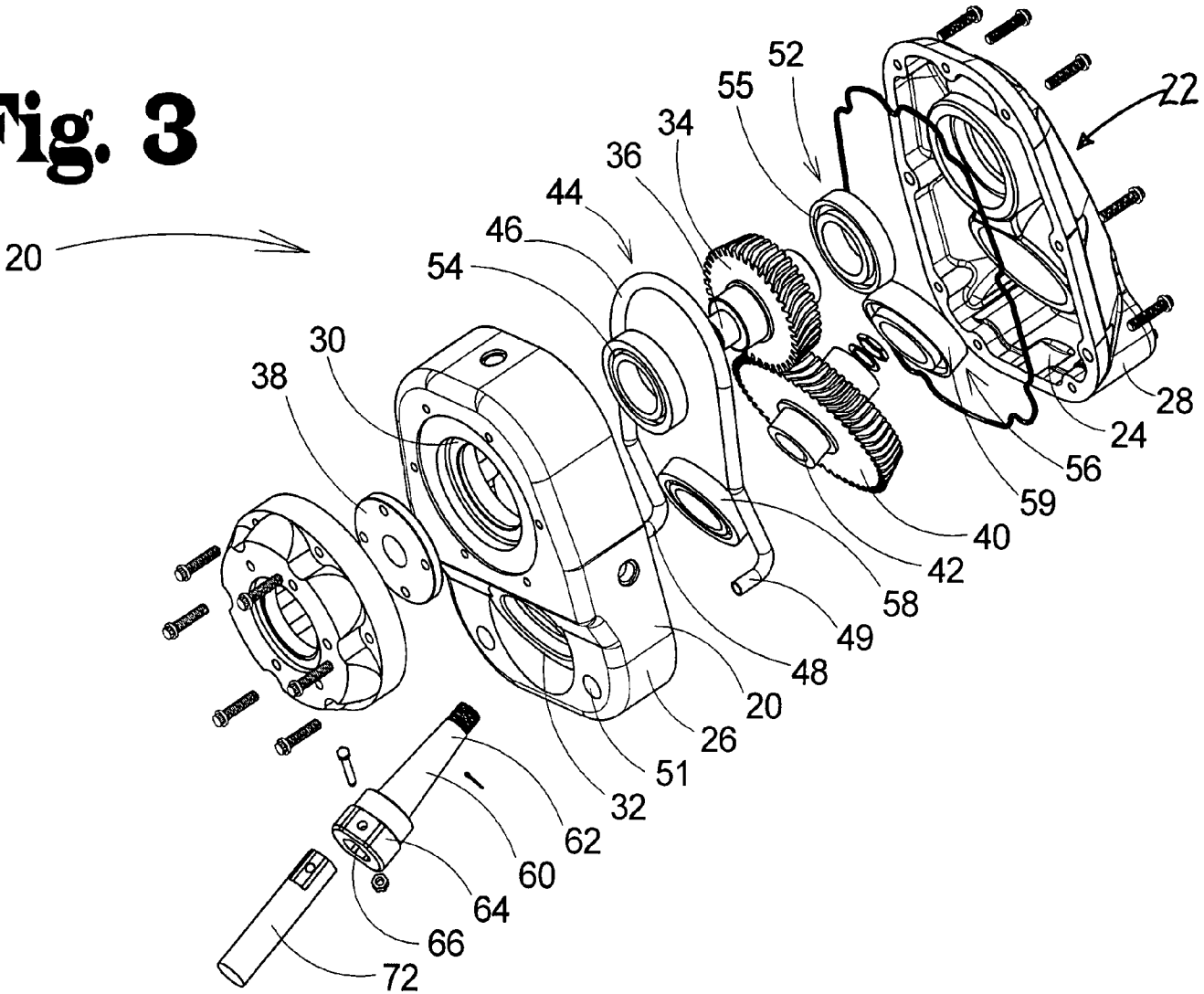
FIG. 3 is a schematic perspective exploded view of the power transfer unit of present invention.
Figure 4:
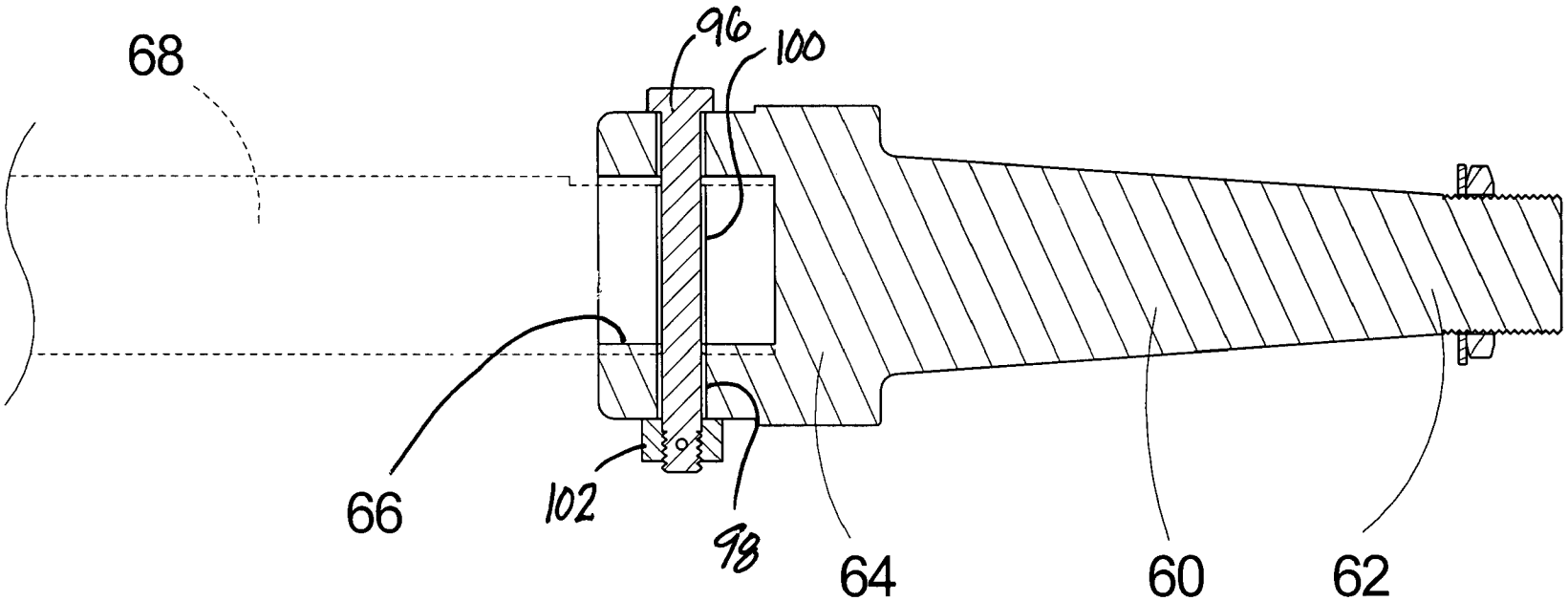
FIG. 4 is a schematic side sectional view of the primary and secondary output shafts of the present invention.
Figure 5:
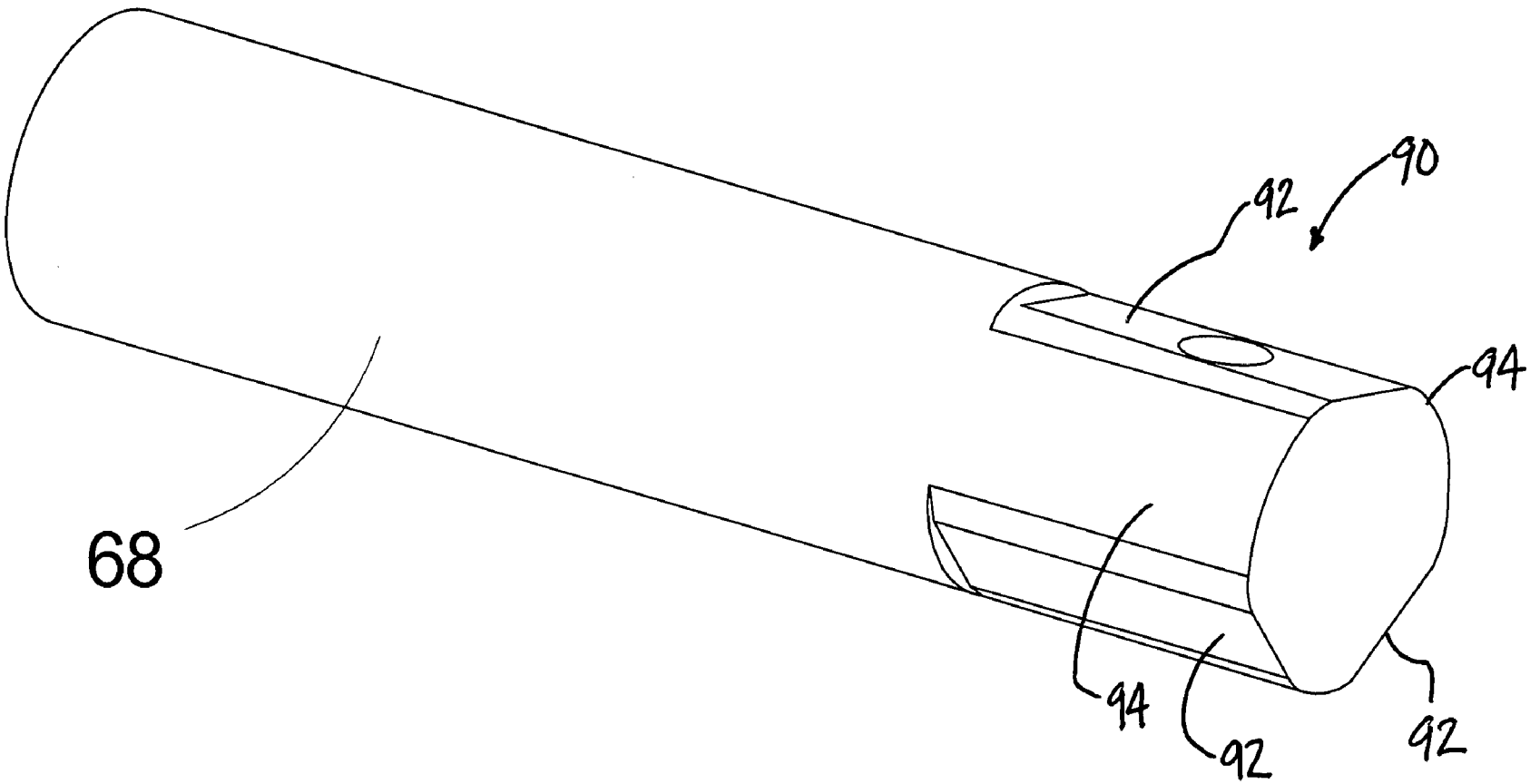
FIG. 5 is a schematic perspective view of the secondary output shaft of the present invention.

With reference now to the drawings, and in particular to FIGS. 1 through 5 thereof, a new marine propulsion system embodying the principles and concepts of the present invention and generally designated by the reference numeral 10 will be described.

The propulsion system 10 of the invention is highly suitable for use on a watercraft 1 with a bow and a stern 3, and having a hull 4 that defines an interior. The hull 4 may include a bottom portion 5 that extends from the bow to the stern 3 of the watercraft 1. The bottom portion 5 may have an inner surface 6 oriented toward the interior of the hull, and an outer surface 7 that contacts the water of a body of water when the watercraft is positioned on the water. The hull 4 may further include a transom portion 8 that extends across the stern of the watercraft 1. The watercraft 1 may also include an upper deck 9 that is mounted on the top of the hull 4.

The propulsion system 10 of the invention provides power for moving or impelling the hull 4 through the body of water. The propulsion system 10 may include an engine 12 or other motor positioned in the interior of the hull 4, and that produces rotation of a driveshaft, and thus may be powered, for example, by a fuel or electricity. The propulsion 10 may further include a power transmission 16 that is connected to the driveshaft of the engine 12, and may have an intermediate shaft that has an adjustable speed of rotation relative to the speed of rotation of the driveshaft.

The propulsion system 10 includes a power transfer unit 20 that changes the direction of the power train from the engine 12 (and optionally the transmission 16) so that the power train extends forwardly in the hull 4 from the engine 12 to the power transfer unit 20 which changes the direction of the power train to a rearward direction relative to the hull 4.

The power transfer unit 20 may comprise a housing 22 which defines an interior 24 that is configured to hold a quantity of lubricant. The housing 22 may have a first portion 26 and a second portion 28, with the first portion 26 being oriented toward the stern 3 of the watercraft 1 and the second portion 28 being oriented toward the bow 2 of the watercraft. The first portion 26 may have an input aperture 30 and an output aperture 32, with the input aperture being located above the output aperture in some embodiments.

The power transfer unit 20 may further comprise an input gear 34 positioned in the interior 24 of the housing 12 that is rotated by the engine 12 (either directly or through an intermediate apparatus such as transmission 16). The input gear 34 is rotatable about a first axis, which may be oriented substantially parallel to an axis of rotation of the driveshaft of the engine. Significantly, the input gear 34 may have a plurality of spiral bevel teeth. The input gear 34 may have an input stub shaft 36 that may be united or mounted for rotation with the input gear. The power transfer unit 20 may further comprise a pinion flange 38 that is positioned in or adjacent to the input aperture 30 in the housing 22 and about the input sub shaft 36 of the input gear 34.

The power transfer unit 20 may also comprise an output gear 40 that is also located in the interior of the housing. The output gear 40 is rotated by the input gear 34 about a second axis, and the second axis may be oriented at an angle to the first axis of the input gear. The angle may be in the range of approximately 10 degrees to approximately 30 degrees, and in some embodiments the angle may be equal to approximately 20 degrees. Significantly, the output gear 40 may also have a plurality of spiral bevel teeth that are intermeshed with the plurality of spiral bevel teeth on the input gear 34. The output gear 40 may have a bore 42. The use of spiral bevel gears for the input and output gears in the power transfer unit provides high strength compared to other tooth shapes, increased longevity for the gears, and quieter performance when compared to the tooth shapes. The positioning of the power transfer unit 20, and more particularly the input 34 and output 40 gears of the unit 20, at the apex of the generally V-shaped configuration of the drive train places significant axial stresses on the gears, and the application of the spiral bevel design to this concentration point of the stresses in the drive train is believed to be significantly more resistant than more conventional designs.

The power transfer unit 20 may comprise a cooling apparatus 44 for receiving a flow of cooling fluid to cool lubricant in the interior of the housing. The cooling fluid may be drawn, for example, from a cooling system of the engine 12 or from water of the body of water on which the watercraft may be situated. The cooling apparatus 44 may comprise a cooling conduit 46 that extends through the interior 24 of the housing. The conduit 46 has an inlet 48 and an outlet 49. The inlet 48 of the cooling conduit 46 may be mounted adjacent to and in communication with an inlet opening 50 in the first portion 26 of the housing. The outlet 49 of the cooling conduit may be mounted adjacent to and in communication with an outlet opening 51 in the first portion 26 of the housing. The cooling conduit 46 may form a loop, and the loop may extend upwardly from the inlet opening 50 and then downwardly to the outlet opening 51.

The power transfer unit 20 may further include an upper bearing assembly 52 for mounting the input gear 34 in the housing 22, which may comprise a pair of upper bearings 54, 55 with each bearing being positioned on a side of the input gear 34. A lower bearing assembly 56 of the power transfer unit 20 may mount the output gear 40 in the housing 22, and may comprise a pair of bearings 58, 59 with each bearing being positioned on a side of the output gear 40.

A primary output shaft 60 may be included in the power transfer unit 20 and may be mounted on the output gear 40 for rotation with the output gear. The primary output shaft 60 may extend from the interior 24 of the housing to an exterior of the housing. The primary output shaft 60 may have a first portion 62 at least partially positioned in the bore 42 of the output gear 40 and a second portion 64 positioned exterior of the housing 22. The first portion 62 of the primary output shaft 60 may have a substantially frusta-conical exterior surface, and an end section of the first portion may have a threaded exterior surface for receiving a securing nut. The second portion 64 may have a bore 66. The power transfer unit 20 may comprise a secondary output shaft 68 that may be removably connected to the primary output shaft 60. The secondary output shaft 68 may have a first end portion 70 that is removably inserted into the bore 66 of the primary output shaft 60 for causing rotation of the secondary output shaft 68 with the primary output shaft 60. The secondary output shaft 68 may also have a second end portion 72 that is connected to a propeller or propeller shaft of the water craft.

In a significant aspect of the invention, the first end portion 70 of the secondary output shaft 68 may include an interlocking section 90 for engaging the bore 66 of the second portion 64 of the primary output shaft 60. The interlocking section 90 may have an exterior surface that includes a plurality of relatively flattened surface areas 92, and may have relatively curved surface areas 94 located between the flattened surface areas 92. The surface areas of the interlocking section 90 may form a cam-like shape or lobed character in cross-section. In one preferred embodiment, three of the flattened surface areas 92 and three of the rounded or curved surface areas 94 are included in the interlocking section 90. An interior of the bore 66 may have a surface with a substantially complementary shape to the interlocking section 90 so that the interlocking section 66 of the secondary output shaft 68 is rotated by the bore 66 of the primary output shaft 60 as a result of the substantially interlocking relationship therebetween. In some embodiments, a bolt 96 is insertable through an aperture 98 in the primary output shaft 60 and through an aperture 100 in the secondary output shaft 102. A fastener 102 such as a nut may be employed to retain the bolt 96 in the apertures 98, 100. A cotter pin (not shown) may also be employed to retain the fastener 102 on the bolt. Those skilled in the art will recognize that other fastening structures may be employed to hold the primary 60 and secondary 68 output shafts in engagement. Significantly, the design of the primary 60 and secondary 68 output shafts permits the shafts to be easily and quickly connected and disconnected when removal of driveline components are needed. The lobed character of the complementary shapes of the output shafts 60, 68 provides easier alignment and mating of the shafts when the driveline is reassembled, as compared to, for example, complementary splines which require a more precise alignment before connection. However, it should be recognized that less preferred embodiments of the present invention may employ a splined shaft and a complementary spline-receiving cavity rather than the lobed shapes described above.

The propulsion system 10 may further include an adjustable propeller assembly 74 for receiving power from the power transfer unit 20 to propel the watercraft in the water. The adjustable propeller assembly 74 comprises a propeller 76 that is rotatable about a propeller axis A. A propeller angle $\alpha$ is defined between the propeller axis A and the outer surface 7 of the hull 4 of the craft may be adjustable. As a result, the propeller angle $\alpha$ between the propeller axis A and the second axis of the output gear 40 may also be adjustable.

The propeller assembly 74 may further include a propeller shaft 78 on which the propeller 76 is mounted, and the propeller shaft may extend generally along the propeller axis A. The propeller shaft 78 may have an inboard end 79 and an outboard end 81. The propeller 76 may be mounted on the outboard end 79 of the propeller shaft, and the inboard end 78 of the propeller shaft may be positioned adjacent to the hull 4 of the watercraft.

The propulsion system 10 may further include a universal joint 80 that joins the propeller shaft 78 to the secondary output shaft 68 in a manner that permits the propeller angle A to be adjusted. The universal joint 80 may be positioned at the hull 4 such that the propeller shaft 78 below the hull is adjustable. The universal joint 80 may be pivotable in a manner permitting movement of the propeller shaft in a substantially vertical plane. The universal joint 80 may comprise any suitable pivotable joint structure that permits substantially constant velocity transfer across the joint.

A support strut 82 may be provided in the propulsion system 10 to support the propeller shaft 78 below the hull 4. The support strut 82 may extend downwardly from the hull 4 to the propeller shaft 78. Significantly, the support strut 82 may be adjustably extendable from the hull such that a distance of extension of the support strut from the hull is adjustable. The support strut 82 may have an upper portion 84 that is positioned in the hull 4, and the upper portion may pass through an aperture 86 that extends through the hull. The position of the support strut 82 in the aperture 86 may thus be adjustable to produce the adjustable extension of the strut from the hull. The support strut 82 may also have a lower portion 88 on which a portion of the propeller shaft 78 is mounted.

The movement of the support strut 82 to move the propeller shaft 78 thus permits the adjustment of the positioning of the propeller 76 relative to the hull, thus providing adjustment in the overall draft of the watercraft and also adjustment of the direction of the thrust provided by the propeller.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A propulsion system for moving a hull of a watercraft through a body of water, the propulsion system comprising:

a power transfer unit, the power transfer unit comprising:

a housing defining an interior;

an input gear positioned in the interior of the housing for being rotated by the engine, the input gear being rotatable about a first axis;

an output gear positioned in the interior of the housing and being rotatable by the input gear, the output gear being rotatable about a second axis, the second axis being oriented at a non-zero angle to the first axis; and a primary output shaft mounted on the output gear for rotation with the output gear, the primary output shaft extending from the interior of the housing to an exterior of the housing;

an adjustable propeller assembly receiving power from the power transfer unit, the adjustable propeller assembly including a propeller, the propeller assembly being configured to enable adjustment of a direction of thrust provided by the propeller along an axis of rotation of the propeller;

wherein the adjustable propeller assembly additionally comprises a propeller shaft on which the propeller is mounted and which extends generally along the propeller axis, the propeller shaft having an inboard end and an outboard end, the propeller being mounted on the outboard end of the propeller shaft;

wherein the propeller assembly includes a universal joint joining the propeller shaft to the output shaft of the power transfer unit in a manner permitting the axis of rotation of the propeller to be adjusted;

wherein the universal joint is configured to be positioned at a wall of the hull of the watercraft such that the output shaft is locatable inside the hull and the propeller shaft is locatable outside of the hull.

2. The propulsion system of claim 1 wherein the angle between the first axis and the second axis is in the range of approximately 10 degrees to approximately 30 degrees.

3. The propulsion system of claim 2 wherein the angle is approximately 20 degrees.

4. The propulsion system of claim 1 wherein the input gear has a plurality of spiral bevel teeth and the output gear has a plurality of spiral bevel teeth intermeshed with the plurality of spiral bevel teeth on the input gear.

5. The propulsion system of claim 1 additionally comprising a cooling apparatus for receiving a flow of cooling fluid to cool lubricant in the interior of the housing, the cooling apparatus comprising a cooling conduit extending upwardly into the interior of the housing.

6. The propulsion system of claim 1 additionally comprising a cooling apparatus, and wherein the cooling apparatus comprises a cooling conduit extending about the primary output shaft in the interior of the housing.

7. The propulsion system of claim 1 additionally comprising a cooling apparatus, and wherein the cooling apparatus comprises a cooling conduit that forms a loop extending through the interior of the housing.

8. The propulsion system of claim 1 wherein the propeller assembly includes a support strut for supporting the propeller shaft below a hull of the watercraft, the support strut extending downwardly from the hull to the propeller shaft.

9. The propulsion system of claim 8 wherein the support strut is adjustably extendable from the hull such that a distance of extension of the support strut from the hull is adjustable.

10. The propulsion system of claim 1 wherein the primary output shaft has a first portion at least partially positioned in the output gear for rotation with the output gear, and the primary output shaft has a second portion positioned exterior of the housing, the second portion having a bore, an interior of the bore of the second portion having a lobed surface; and wherein the power transfer unit additionally comprises a secondary output shaft removably connected to the primary output shaft, the secondary output shaft having a first end portion with a lobed exterior surface that is removably inserted into the bore of the primary output shaft for causing rotation of the secondary output shaft with the primary output shaft.

11. The propulsion system of claim 1 additionally comprising a cooling apparatus for receiving a flow of cooling fluid to cool lubricant in the interior of the housing, the cooling apparatus being positioned at a lower portion of the interior of the housing.

12. The propulsion system of claim 1 wherein the angle between the first axis and the second axis is in the range of approximately 10 degrees to approximately 30 degrees;

wherein the input gear has a plurality of spiral bevel teeth and the output gear has a plurality of spiral bevel teeth intermeshed with the plurality of spiral bevel teeth on the input gear;

a cooling apparatus for receiving a flow of cooling fluid to cool lubricant in the interior of the housing, the cooling apparatus comprising a cooling conduit extending upwardly into the interior of the housing, the cooling conduit forming a loop extending through the interior of the housing, the cooling conduit extending about the primary output shaft in the interior of the housing;

wherein the propeller assembly includes a support strut for supporting the propeller shaft below a hull of the watercraft, the support strut extending downwardly from the hull to the propeller shaft;

wherein the support strut is adjustably extendable from the hull such that a distance of extension of the support strut from the hull is adjustable; and wherein the power transfer unit additionally comprises a secondary output shaft removably connected to the primary output shaft, the secondary output shaft having a first end portion with a lobed exterior surface that is removably inserted into the bore of the primary output shaft for causing rotation of the secondary output shaft with the primary output shaft.

13. A propulsion system for moving a hull of a watercraft through a body of water, the propulsion system comprising:

a power transfer unit, the power transfer unit comprising:

a housing defining an interior;

an input gear positioned in the interior of the housing for being rotated by the engine, the input gear being rotatable about a first axis;

an output gear positioned in the interior of the housing and being rotatable by the input gear, the output gear being rotatable about a second axis, the second axis being oriented at a non-zero angle to the first axis;

a primary output shaft mounted on the output gear for rotation with the output gear, the primary output shaft extending from the interior of the housing to an exterior of the housing;

a cooling apparatus configured to receive a flow of cooling fluid to cool lubricant in the interior of the housing, the cooling apparatus comprising a cooling conduit extending into the interior of the housing;

wherein the cooling conduit extends about the primary output shaft in the interior of the housing.

14. The propulsion system of claim 13 wherein the cooling conduit extends upwardly into the interior of the housing.

15. The propulsion system of claim 13 wherein the cooling conduit that forms a loop extending through the interior of the housing.

16. The propulsion system of claim 13 wherein the cooling conduit extends upwardly into the interior of the housing;

wherein the cooling conduit that forms a loop extending through the interior of the housing.

17. A watercraft comprising:

a hull defining an interior, the hull having a bottom wall that is oriented in a substantially horizontal orientation when the hull is placed in a body of water;

a propulsion system for moving the hull through a body of water, the propulsion system comprising:

a power transfer unit comprising:

a housing defining an interior;

an input gear positioned in the interior of the housing for being rotated by the engine, the input gear being rotatable about a first axis;

an output gear positioned in the interior of the housing and being rotatable by the input gear, the output gear being rotatable about a second axis, the second axis being oriented at a non-zero angle to the first axis;

a primary output shaft mounted on the output gear for rotation with the output gear, the primary output shaft extending from the interior of the housing to an exterior of the housing;

an adjustable propeller assembly receiving power from the power transfer unit, the adjustable propeller assembly including a propeller, the propeller assembly being configured to enable adjustment of a direction of thrust provided by the propeller along an axis of rotation of the propeller;

wherein the adjustable propeller assembly additionally comprises a propeller shaft on which the propeller is mounted and which extends generally along the propeller axis, the propeller shaft having an inboard end and an outboard end, the propeller being mounted on the outboard end of the propeller shaft;

wherein the propeller assembly includes a universal joint joining the propeller shaft to the output shaft of the power transfer unit in a manner permitting the axis of rotation of the propeller to be adjusted;

wherein the universal joint is positioned at the bottom wall of the hull such that the output shaft is located inside the hull and the propeller shaft is located outside of the hull.

18. The propulsion system of claim 17 wherein the universal joint swivels at a swivel point, the swivel point being located substantially in a plane of the bottom wall of the hull.

19. The propulsion system of claim 17 wherein the output shaft positioned inside the hull is substantially stationary when the propeller shaft outside the hull is moved to adjust the axis of rotation of the propeller.

20. The propulsion system of claim 17 wherein the adjustable propeller assembly is configured to permit adjustment of the axis of rotation of the propeller in a substantially vertical plane.

* * * * *